United States Patent [19]

Lane

[11] 4,449,778

[45] May 22, 1984

[54] SHIELDED ELECTRICAL CONNECTOR

[75] Inventor: David Lane, Greensboro, N.C.

[73] Assignee: AMP Incorporated, Harrisburg, Pa.

[21] Appl. No.: 452,171

[22] Filed: Dec. 22, 1982

[51] Int. Cl.[3] ..... H01R 13/648

[52] U.S. Cl. ..... 339/143 R; 339/107

[58] Field of Search ..... 339/107, 136 RM, 141, 339/142, 143 R; 174/35 C

[56] References Cited

U.S. PATENT DOCUMENTS 4,120,553 10/1978 Muz ..... 339/143 R X
4,127,315 11/1978 McKee ..... 339/107 X
4,215,236 7/1980 Reiser ..... 339/141 X

*Primary Examiner*—Eugene F. Desmond
*Attorney, Agent, or Firm*—Robert W. J. Usher

[57] ABSTRACT

An electrical connector shield includes a one-piece base member having a cable braid connecting portion comprising a panel from respective opposite sides and the rear of which upstand flanges formed with cable-receiving apertures opening away from the panel. Each aperture has inturned cable gripping lips. A closure member is provided for latching receipt on the base member with a detent action. A connector includes a terminal housing received between the base and closure members and having hood and platform portions providing supports for contact portions of the shield at a mating face.

5 Claims, 8 Drawing Figures

SHIELDED ELECTRICAL CONNECTOR

The invention relates to a shielded electrical connector.

There is an increasing requirement for shielded electrical connectors; for example, in data equipment. It is important that the connector shield be effective and yet be readily secured in the field to the shielding braid of a shielded cable. The connector shield should also accommodate different directions of cable lead out from the connector; for example, both in axial and orthogonal directions.

According to the invention, an electrical connector shield comprises base and closure members each stamped and formed in one piece from sheet metal with a rear, braid connecting portion and a front, contact portion, the braid connecting portion of the base member comprising a panel from respective opposite sides and the rear of which upstand flanges formed respectively with cable receiving apertures opening away from the panel, respective opposite sides of each aperture being provided with resilient, inturned cable gripping lips, the braid connecting portion of the closure member comprising a panel from opposite sides of which depend flanges formed with cable receiving apertures, aligned latching detents and apertures being provided on the flange of the base and closure member so that the closure member can be latched to the base member substantially completely surrounding and retaining a cable with exposed braid shield received as a press fit between the lips of a preselected one of the apertures in the base and the contact portions being adapted to mate with contact portions of another similar electrical connector shield.

Thus, provision is made for cable lead out in various orientations together with easy and secure assembly with the cable in the field.

According to another aspect of the invention, there is provided an electrical connector including a connector shield as described above and a terminal housing comprising a terminal supporting platform extending between contact and wire connecting faces of the housing, side walls upstanding from respective opposite sides of the platform and bridged at the contact face by a forwardly projecting hood, the arrangement being such that the base member can be latched to the closure member with the terminal housing located between them, the contact portions of the closure and base member being received under the hood and under the platform respectively.

The above construction enables reliable and relatively easy assembly the shield and terminal support. The undersurface of the hood may provide a support to prevent overstress of contact portions of the closure member which may be resiliently flexible while the undersurface of the platform may provide support for the contact portion of the base member. Considerable shielding is also afforded to terminals and cable leads in the terminal housing.

An example of a connector according to the invention, will now be described with reference to the accompanying drawings in which:

FIG. 5 is a cross-sectional view of the connector pair of FIG. 4 after mating;

Figure 1:
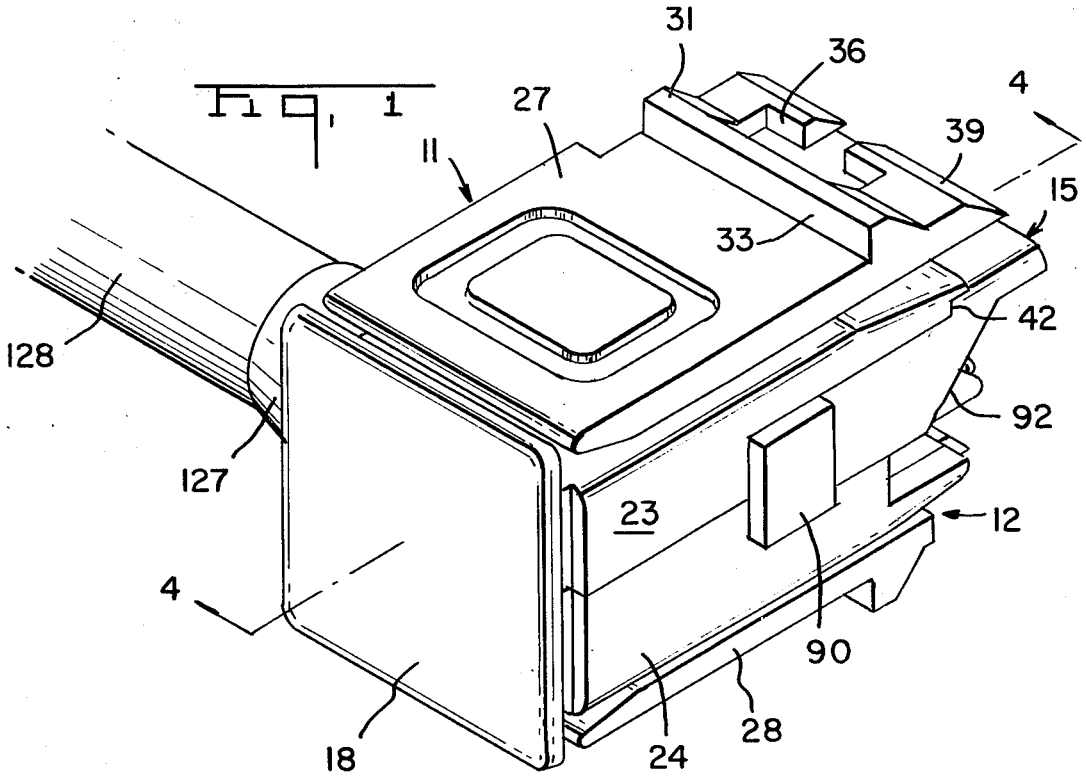
FIG. 1 is a perspective view of the connector with orthogonal cable lead out.
Figure 2:
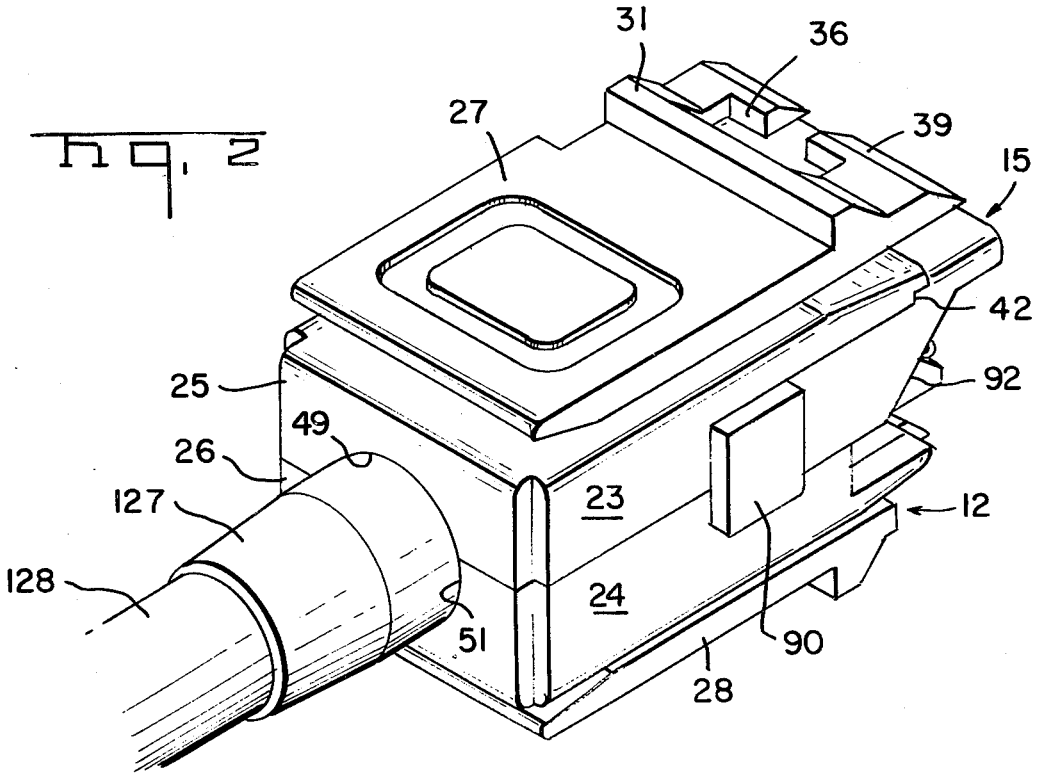
FIG. 2 is a perspective view of the connector with axial cable lead out.
Figure 3:
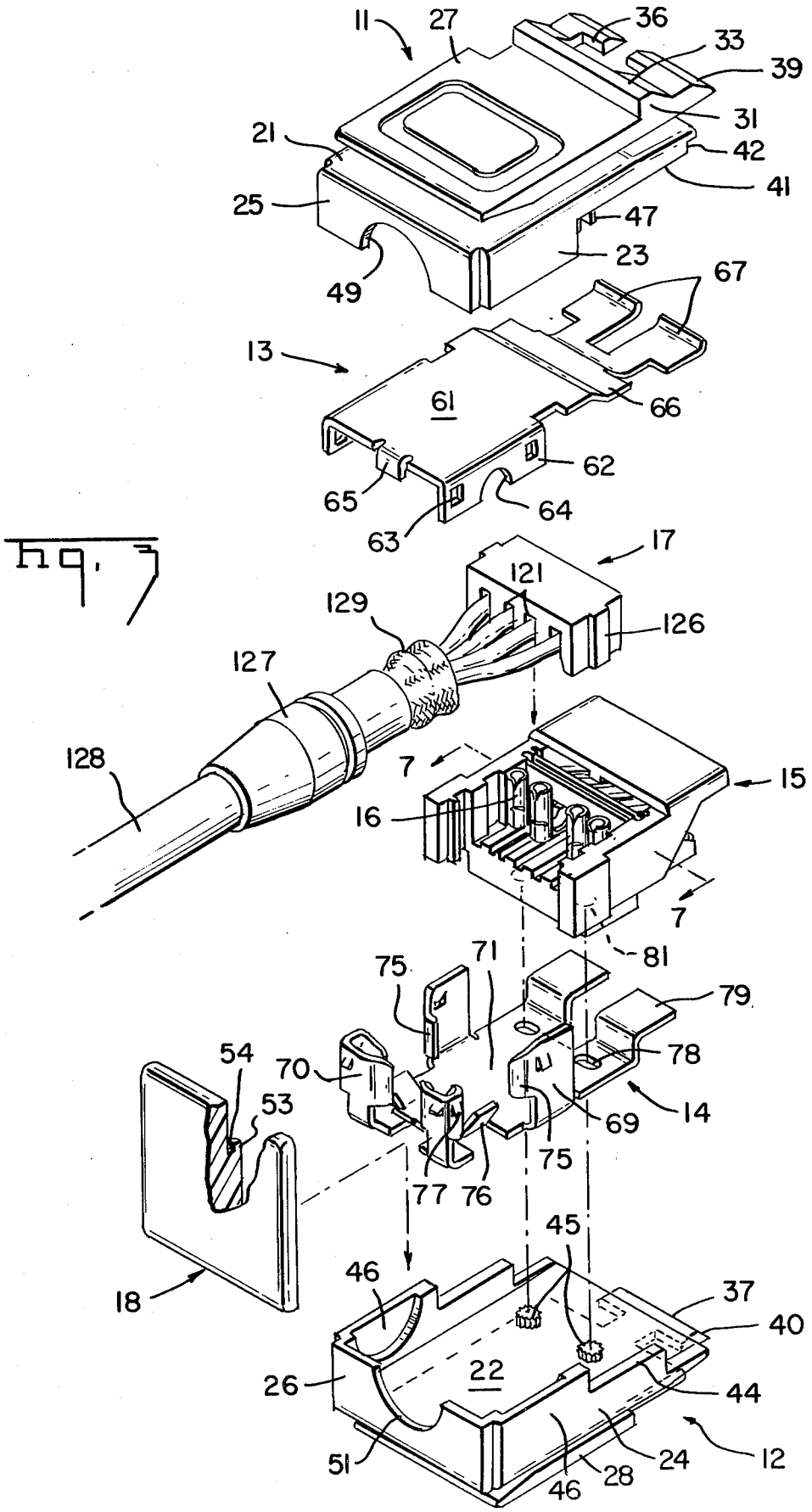
FIG. 3 is an exploded perspective view of the connector.
Figure 4:
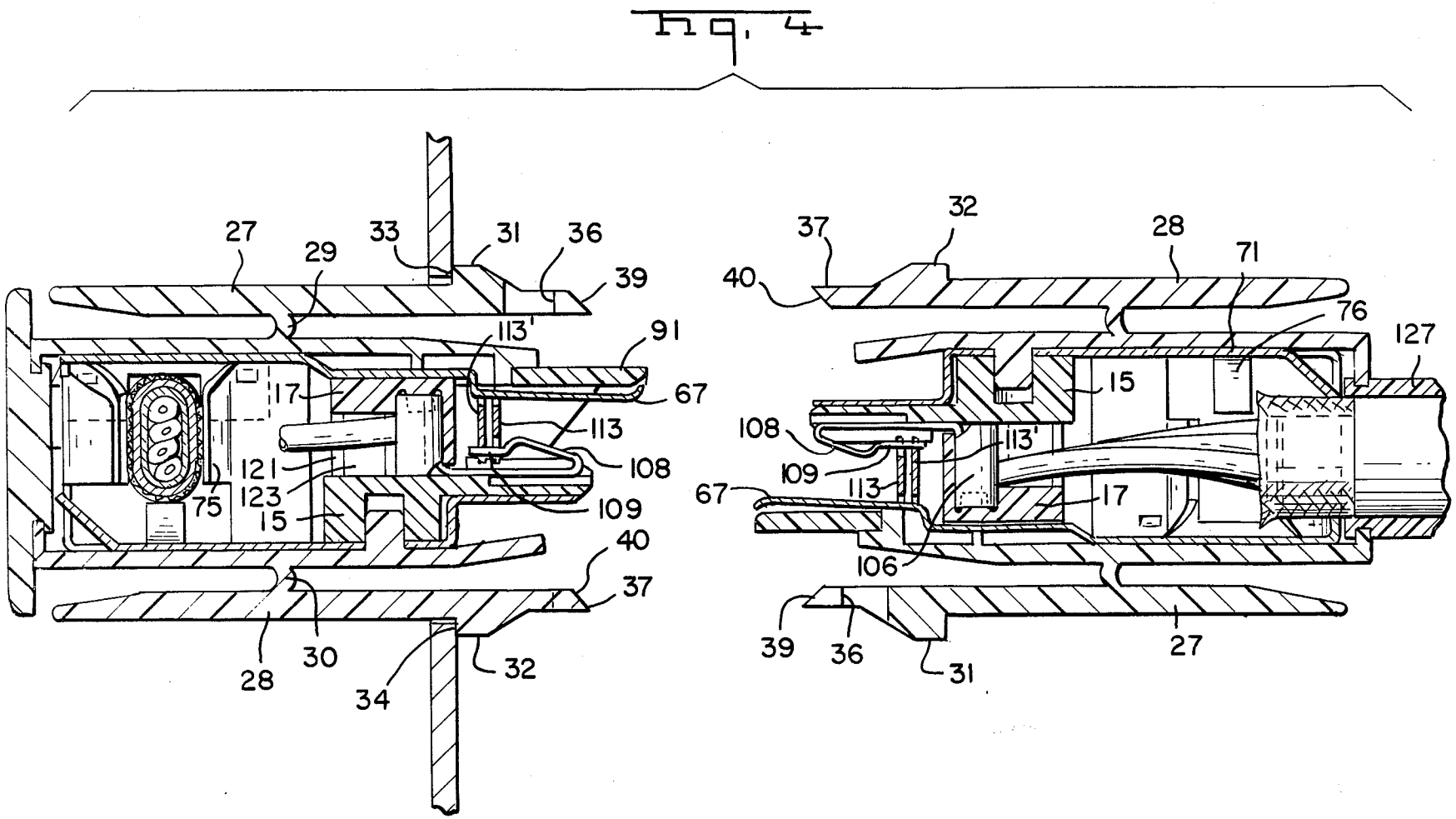
FIG. 4 is a cross-sectional view taken along line 4–4 of FIG. 1 of a pair of similar connectors aligned for mating.

Each connector is of identical hemaphroditic construction and as shown particularly in FIG. 3, comprise a bipartite cover 10 having upper and lower cover parts 11 and 12, respectively, of insulating plastics material, upper and lower cable clamping ground shields 13 and 14 respectively, a housing 15 for terminals 16 and a wire stuffer 17. A rear cap 18 is provided for attachment to the cover where axial cable lead out is not required.

Figure 6:
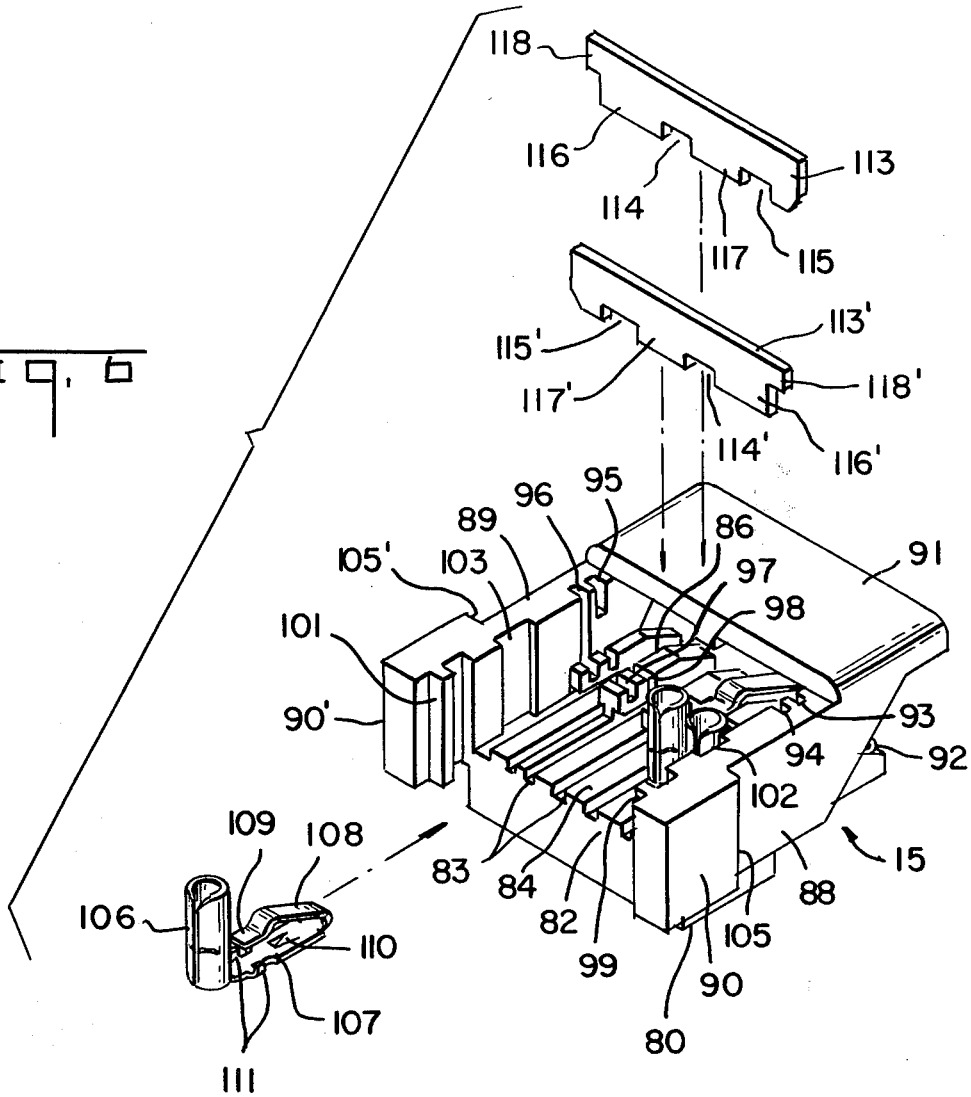
FIG. 6 is an exploded perspective view showing a terminal housing of the connector in greater detail.
Figure 7:
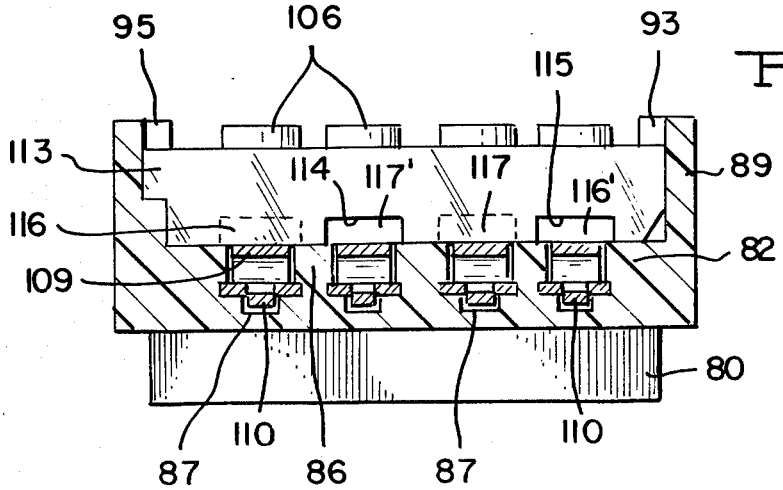
Figure 8:
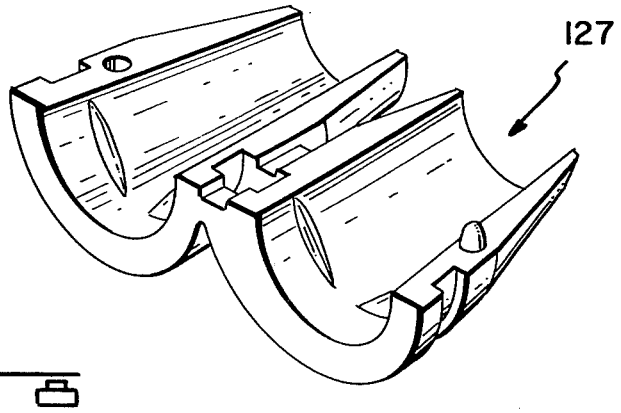

As shown particularly in FIGS. 3 and 6, the upper and lower cover parts 11 and 12 are each moulded in one piece of plastics material and comprise box-like constructions open at a front having respectively, base walls 21 and 22, pairs of opposite side walls 23 and 24 and rear walls 25 and 26. The covers are integrally formed with latching arms 27 and 28, respectively joined to the exterior of the side walls intermediate front and rear ends by web hinges 29 and 30 (as shown particularly in FIG. 5). Panel mounting ribs 31 and 32 defining rearwardly facing shoulders 33 and 34 and having canted, forwardly facing surfaces extend transversely across the arms adjacent front, mating ends which are formed with complimentary latches comprising a T-slot 36 in one arm 27 for receiving a T-bar 37 in the other arm 28 having, respectively, canted lead-in surfaces 39 and 40. The side walls of the upper cover part 11 are rebated towards a front end to provide a terminal housing, receiving recess 41. A transverse shield-locating rib 42 extends across the cover interior in parallel relation to a locating lip 42 stepped back from the front end.

The side walls 24 of the lower cover part 12 are also rebated towards a front end to provide a terminal having receiving recess 44 and a pair of terminal housing locating studs 45 upstand from the base wall adjacent the front end. Frangible portions 46 are provided in the side walls of both upper and lower cover parts to permit optional cable lead out directions. Cable receiving recess 49 and 51 are provided in both rear walls to permit axial cable lead out. Cap 18 has a locating boss 53 with a peripheral groove 54 receiving the lips of the recesses 49 and 51 when axial lead out is not desired.

The upper shield 13 is stamped and formed from a single piece of sheet metal and comprises a base panel 61 from opposite sides of which depend flanges 62 having latching apertures 63 on each side of a cable receiving recess 64. A braid contacting tab 65 depends from a rear of the panel and a forwardly extending portion 66 is stepped and extends to a bifurcated contact portion having contact tabs with enlarged, upturned contact surfaces 67 at their front ends.

The lower shield 14 is also stamped and formed from one piece of sheet metal stock and comprises flanges 69, 70 that upstand from the opposite sides and the rear of a base panel 71, cable receiving apertures 73 and 74 being provided in such flange and being defined by inturned cable gripping lips 75 on respective opposite sides of each aperture. Braid connecting tabs 76 are pushed out of the base panel adjacent each aperture. Latching detents 77 are provided on the flanges for receipt in the latching apertures 63 where the upper shield is applied to the lower shield. A forwardly extending portion of the base panel is provided with a pair of stud receiving apertures 78 and the front of the base panel is bifurcated and stepped to provide contact surfaces 79 for establishing electrical connection with the contact surfaces 67 of the shield of a mating connector half, as shown in FIG. 5.

The terminal housing 15 is moulded in one piece of plastics material and comprises a foot 80 supporting a terminal platform 82 extending between forward, mating and rear, wire connecting faces of the housing. A series of parallel channels 83 extend forwardly across the wire connecting platform at the wire connecting face defining between them undercut terminal supporting ribs 84. Parallel locking grooves 87 extend rearwardly in alignment with the ribs from the front of the platform. Side walls 88 and 89 upstand from respective opposite side edges of the terminal supporting platform and are bridged at a front end by a hood 91. The side walls have canted leading edges 92 extending from locations adjacent the platform 82 to locations adjacent the front end of the hood. Pairs of aligned downwardly extending slots 93 and 95, 94 and 96 are formed in the side walls adjacent the hood, slots 94 and 95 being less extensive than aligned slots 93 and 96. Slots 97 and 98 are also formed across the ribs 84 in alignment with the respective slots in the side walls.

Adjacent the rear of the housing 15, longitudinally extending portions of the side walls are formed with vertical locating ribs 99, 101 and laterally extending side wall portions 90, 90 define forwardly facing mounting shoulders 105, 105 for abutment with the edges of a panel aperture. Vertically extending guide channels 102 and 103 are located in each side wall intermediate the ribs and the rear of the terminal platform.

Each terminal 16 is stamped and formed from a single piece of sheet metal stock and comprises an upstanding slotted wire-receiving barrel portion similar to that described in our U.S. Pat. No. 3,860,318 connected by a neck to a body portion 107 from a front end of which extends a reversely bent contact tongue 108 formed with a step 109 at a free end. A locking lance 110 is pushed out from the base and locking ears 111 upstand from respective opposite edges of the base. The terminals are assembled with the housing by insertion from the rear until their locking lances resile into the locking slots 110 when side edges of the body portion will be located in the undercut areas under adjacent rear surfaces of the adjacent barrier walls, preventing further movement of the terminals in any direction. The contact tongues 108 will then be exposed at the mating face.

Figure 7:
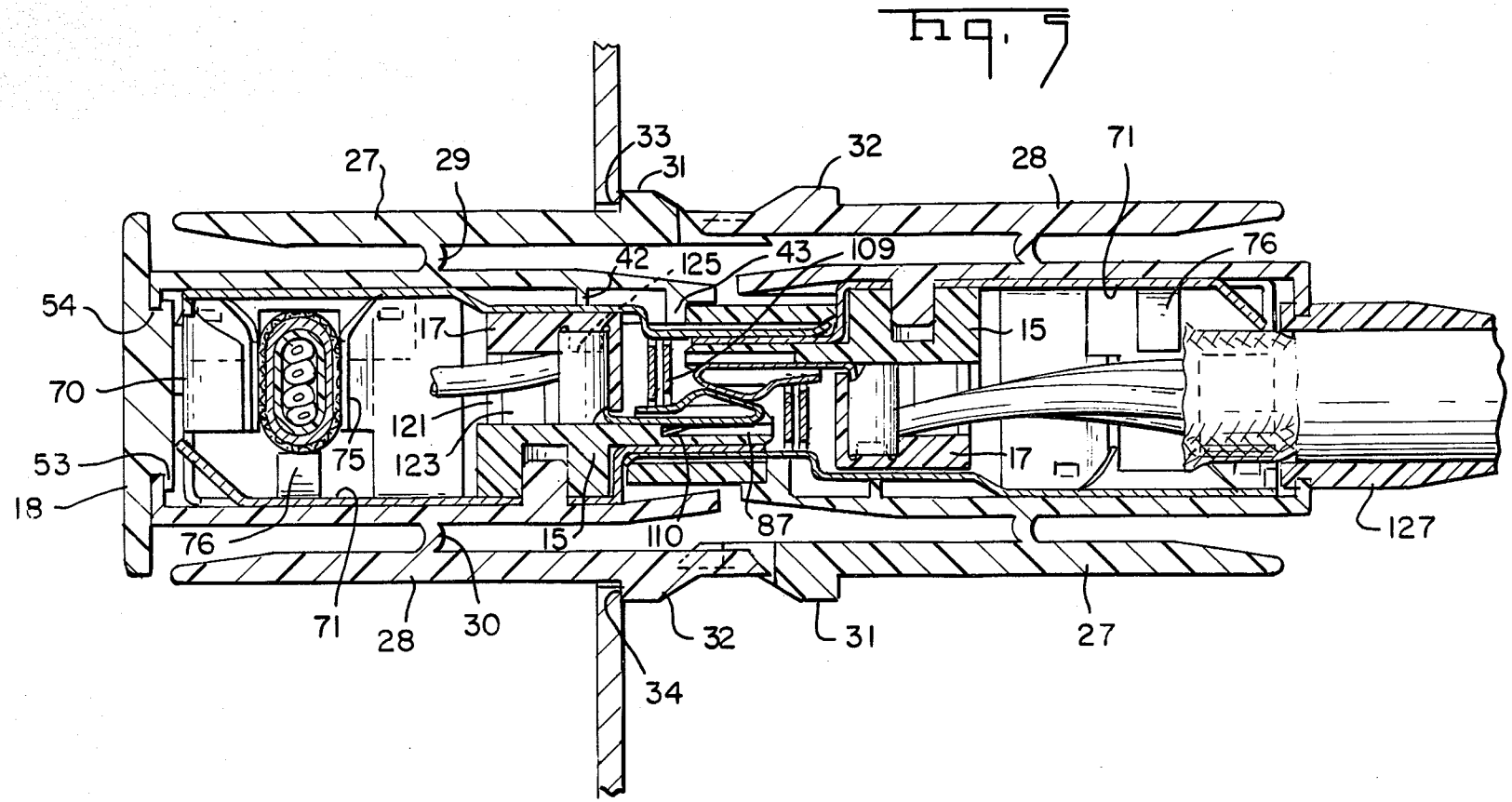
FIG. 7 is a cross-sectional view of the terminal housing taken along line 7—7 of FIG. 3; and, FIG. 8 is a perspective view of a bush for use with the connector.

Identical shunting bars 113, 113 are stamped from single pieces of sheet metal with spaced apertures 114, 114 and 115, 115 defining between them contact lugs 116, 116 and 117, 117 extending from a bridge portion. Tabs 118, 118 extend from an end of each shunting bar. The shunting bars 113, 113 are located in respective aligned slots 93, 95, 97 and 94, 96, 98, mutually orientated at 180 so that tabs 118, 118 are received in the shorter slots 95, 94 respectively. It should be noted that, as shown in FIG. 7, the apertures of one shunting bar are aligned with the contact lugs of the other bar because of the asymmetric location of the apertures with the result that the contact lugs 116, 117 engage stepped ends and shunt the first and third terminals and contact lugs 116, 117 engage stepped ends of the second or fourth terminals.

The stuffer 17 is moulded in one piece of stiffly flexible plastics material with a series of internal partition walls 123 defining wire receiving passageways extending between outer and inner wire gripping lip pairs 121 and 124 to a cylindrical barrel receiving portion having a cylindrical wire engaging projection 125 similar to that described in our U.S. Pat. No. 4,186,984. Vertical guiding ribs 126 extend on respective opposite ends.

In assembling the connector, the terminals 16 are inserted into the housing 15 as described above and the shunting bars 113, 113 are then inserted into the slots to shunt desired alternate terminals.

A hinged bush 127 is applied to a stripped shielded cable 128 in which shielding braid 129 has been reversely bent to extend rearwardly across a waisted supporting ferrule to clamp the braid and the individual insulated cable wires located in the stuffer passageways shown in FIG. 3. The stuffer is then urged downwardly guided by the cooperation of the ribs 126 and the grooves 102, 103 simultaneously into the wire receiving slots of the barrel portions.

The lower ground shield may be heat staked or otherwise secured in the cover with the studs 45 registering within apertures 78. The terminal housing 15 terminating the wires is then assembled with the lower ground shield, the exposed braid portion being urged between the resilient lips 75 supported by the ferrule to establish electrical contact with the cable shield and ground. A tab 76 also engages the braid. The upper ground shield 13 is then applied to the housing 15 with the contact surfaces inserted under the hood 91 on opposite sides of an axial rib and to the lower ground shield so that the latching detents 77 are received in apertures 63 when the tab 55 will also engage the cable (with axial lead out) or the lips of a cable receiving recess 64.

The upper cover is then applied to the terminal housing 15 and to the lower cover (with the rear cap 18 omitted where axial lead out is desired) the locating ribs 99, 101 on the terminal housing cooperating with the grooved lugs 47.

On inserting the connector in a panel aperture, the shoulders 33 of the mounting ribs 31 snap behind the edges of the panel aperture on the other side of the panel preventing withdrawal while the shoulders 105, 105 abut the edges on the rear side preventing over insertion. An identical connector rotated through 180 is mated with the mounted connector by the T-bar being received in the T-slot providing a remarkably stable structure. On mating, the contact tongues 108 of the two connectors interengage depressing the stepped ends 109 out of engagement with the contact lugs 116, 117 of the shunting bars and the contact surfaces 79 and 67 of respective connector shields engage so that the ground shields substantially completely surround the exposed wires and the contacts irrespective of cable lead out direction providing braid-to-braid shielding.

The connector assembly is relatively inexpensive to manufacture in relation to its versatility and reliability of operation providing both reliable electrical characteristics and mechanical mating and mounting characteristics.

I claim:

1. An electrical connector shield comprising base and closure members each stamped and formed in one piece from sheet metal with a rear, braid connecting portion and a front, contact portion, the braid connecting portion of the base member comprising a panel from respective opposite sides and the rear of which upstand flanges formed respectively with cable receiving apertures opening away from the panel, respective opposite sides of each aperture being provided with resilient, inturned cable gripping lips, the braid connecting portion of the closure member comprising a panel from opposite sides of which depend flanges formed with cable receiving apertures, aligned latching detents and apertures being provided on the flanges of the base and closure members so that the closure member can be latched to the base member substantially completely surrounding and retaining a cable with exposed braid shield received as a press fit between the lips of preselected one of the apertures in the base and the contact portions being adapted to mate with contact portions of another similar electrical connector shield.

2. An electrical connector shield according to claim 1 in which resilient braid contacting tabs are pushed out from the base panel at locations adjacent each cable receiving aperture.

3. An electrical connector shield according to claim 1 in which the contact portions of the members are bifurcated, the contact portion of one member being resiliently flexible.

4. An electrical connector including an electrical connector shield according to claim 1 and a terminal housing comprising a terminal supporting platform extending between contact and wire connecting faces of the housing, side walls upstanding from respective opposite sides of the platform and bridged at the contact face by a forwardly projecting hood, the arrangement being such that the base member can be latched to the closure member with the terminal housing located between them, the contact portions of the closure and base member being received under the hood and under the platform respectively.

5. An electrical connector according to claim 4 including a bipartite cover, each cover part having a base and side and rear wall upstanding from the base and being open at a front contact face, the side walls being formed with frangible portions aligned with the cable receiving apertures on assembling the cover and the base to enclose the shield and terminal housing.

* * * * *